US011377774B2

(12) United States Patent
Lv et al.

(10) Patent No.: US 11,377,774 B2
(45) Date of Patent: Jul. 5, 2022

(54) DRUM WASHING MACHINE, AND SPRAYING SYSTEM AND SEALED WINDOW PAD THEREOF

(71) Applicants: QINGDAO HAIER DRUM WASHING MACHINE CO., LTD., Shandong (CN); Haier Smart Home Co., Ltd., Shandong (CN)

(72) Inventors: Peishi Lv, Qingdao (CN); Sheng Xu, Qingdao (CN); Zhiqiang Zhao, Qingdao (CN); Xinyu Zhao, Qingdao (CN)

(73) Assignees: QINGDAO HAIER DRUM WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 0 days.

(21) Appl. No.: 17/054,275

(22) PCT Filed: Apr. 30, 2019

(86) PCT No.: PCT/CN2019/085249
§ 371 (c)(1),
(2) Date: Nov. 10, 2020

(87) PCT Pub. No.: WO2019/214515
PCT Pub. Date: Nov. 14, 2019

(65) Prior Publication Data

US 2021/0246599 A1 Aug. 12, 2021

(30) Foreign Application Priority Data

May 10, 2018 (CN) ..... 201810443177.7

(51) Int. Cl.
*D06F 39/08* (2006.01)
*D06F 37/42* (2006.01)

(52) U.S. Cl.
CPC ..... *D06F 39/08* (2013.01); *D06F 39/085* (2013.01); *D06F 39/088* (2013.01); *D06F 37/42* (2013.01)

(58) Field of Classification Search
CPC .... D06F 39/088; D06F 39/083; D06F 37/266; D06F 39/085; D06F 2105/06;
(Continued)

(56) References Cited

U.S. PATENT DOCUMENTS 6,205,603 B1 * 3/2001 Vande Haar ..... D06F 39/088 68/23.2
2008/0201868 A1 * 8/2008 Bang ..... D06F 35/006 68/12.02
(Continued)

FOREIGN PATENT DOCUMENTS

CN 2377270 Y 5/2000
CN 2908579 Y 6/2007
(Continued)

OTHER PUBLICATIONS

Ushijima; Hideaki, "Washing Machine", Sep. 2016, WO 2016136154 A1—Machine Translation (Year: 2016).*
(Continued)

*Primary Examiner* — David G Cormier
*Assistant Examiner* — Thomas Bucci
(74) *Attorney, Agent, or Firm* — Maier & Maier, PLLC

(57) ABSTRACT

A drum washing machine and a spraying system and a sealed window gasket. The drum washing machine includes a box, an outer barrel and an inner barrel that are arranged from outside to inside, the sealed window gasket is arranged between the box and the outer barrel. The spraying system includes a circulating pump, a water retaining structure and water spraying pipes, a water inlet of the circulating pump extends into the outer barrel, and a water outlet of the
(Continued)

circulating pump is in communication with the p water spraying pipes; the water spraying pipes are all arranged on the sealed window gasket; and the water retaining structure is arranged inside the sealed window gasket, and the water retaining structure is provided such that washing water sprayed from each water spraying pipe can be scattered and reflected into the inner barrel. Thus, maintenance and installation are simpler.

6 Claims, 5 Drawing Sheets

(58) Field of Classification Search
CPC ..... D06F 39/008; D06F 37/267; D06F 39/12; A47L 15/4246; A47L 15/4234; A47L 15/4257; A47L 15/4214; A47L 15/4221; A47L 15/16; A47L 15/4278; A47L 15/4225
USPC ..... 68/18 R
See application file for complete search history.

(56) References Cited

U.S. PATENT DOCUMENTS

2009/0095030 A1* 4/2009 Kang ..... D06F 39/00 68/13 R
2009/0126418 A1* 5/2009 Shin ..... D06F 35/00 68/208
2009/0249838 A1* 10/2009 Kim ..... D06F 39/083 68/58
2011/0083477 A1* 4/2011 Kim ..... D06F 37/266 68/140
2014/0033449 A1* 2/2014 Im ..... D06F 33/34 8/137
2014/0299164 A1* 10/2014 Zhang ..... D06F 33/43 134/199
2014/0352363 A1* 12/2014 Kim ..... D06F 37/266 239/600
2018/0117645 A1* 5/2018 Kwon ..... D06F 35/008
2019/0136438 A1* 5/2019 Lee ..... D06F 37/266
2019/0203405 A1* 7/2019 Lee ..... D06F 39/083
2019/0323162 A1* 10/2019 Jung ..... D06F 39/083

FOREIGN PATENT DOCUMENTS

CN 105274770 A 1/2016
CN 204982446 U 1/2016
CN 105862310 A 8/2016
CN 106702685 A 5/2017
WO 2016/136154 A1 9/2016
WO WO-2016136154 A1 * 9/2016

OTHER PUBLICATIONS

International Search Report dated Jul. 25, 2019 in corresponding International Application No. PCT/CN2019/085249; 4 pages.

* cited by examiner

DRUM WASHING MACHINE, AND SPRAYING SYSTEM AND SEALED WINDOW PAD THEREOF

FIELD

The present disclosure belongs to the field of household appliances, and specifically provides a drum washing machine as well as a spraying system and a sealing window gasket thereof.

BACKGROUND

Existing drum washing machines originated from Europe, and mainly include a box, an outer cylinder and an inner cylinder from outside to inside. The working method of the drum washing machine is similar to the principle of hammering clothes using a wooden club. During operation, the inner cylinder is driven by a drive motor to rotate. With the rotation of the inner cylinder, the clothes are continuously lifted and dropped in the drum, and then lifted and dropped again; such movements are repeated again and again. Under a joint action of washing powder and water, the clothes are washed clean.

In order to improve the effect of washing and rinsing clothes with water flow, some drum washing machines are also provided with a circulating spraying device. For example, the drum washing machine disclosed in the patent publication No. CN204982446U includes a box, a drum and a water tub in sequence from outside to inside. The water tub is provided with a water tub frame, and the water tub frame is provided with a spray hole for spraying a water flow into the drum, and a diversion mechanism for guiding the sprayed water flow to be diffused in a circumferential direction. After a water column coming from the spray hole is sprayed to the diversion mechanism, the width is enlarged, and the water column is adjusted to a fan shape before being sprayed to the inner cylinder.

Although the drum washing machine disclosed in the patent publication No. CN204982446U has a strong ability of cleaning clothes, the structures of the spray hole and the diversion mechanism thereof are complicated, and the production cost is high.

Accordingly, there is a need in the art for a new drum washing machine and a spraying system thereof to solve the above problems.

SUMMARY

In order to solve the above-mentioned problems in the related art, that is, to solve the problems of complicated installation structure and high production cost of the spraying devices of existing drum washing machines with a circulating spraying function, the present disclosure provides a spraying system of a drum washing machine, the drum washing machine including a box, an outer cylinder and an inner cylinder disposed in sequence from outside to inside, and a sealing window gasket being disposed between the box and the outer cylinder; the spraying system includes a circulating pump, a water retaining structure and a plurality of water spraying pipes; a water inlet of the circulating pump opens into the outer cylinder, and a water outlet of the circulating pump communicates with the plurality of water spraying pipes respectively for pumping washing water in the outer cylinder to the plurality of water spraying pipes; each of the plurality of water spraying pipes is disposed on the sealing window gasket; the water retaining structure is disposed on an inner side of the sealing window gasket, and the water retaining structure is configured to be able to scatter washing water sprayed from each of the water spraying pipes and reflect the washing water into the inner cylinder.

In a preferred technical solution of the above spraying system, the water retaining structure includes a water retaining ring fixed to or formed on the sealing window gasket.

In a preferred technical solution of the above spraying system, the water retaining structure includes a plurality of water retaining pieces disposed at intervals, which are fixed to or formed on the sealing window gasket, and each of the water retaining pieces corresponds to one of the water spraying pipes.

In a preferred technical solution of the above spraying system, the water retaining structure is inclined toward one side of the outer cylinder.

In a preferred technical solution of the above spraying system, a groove is provided on the sealing window gasket, and a water outlet end of each of the water spraying pipes is disposed in the groove.

In a preferred technical solution of the above spraying system, the groove is a single annular groove; or the groove is provided in plural, and each of the grooves corresponds to one of the water spraying pipes.

In a preferred technical solution of the above spraying system, the plurality of water spraying pipes are disposed at equal intervals in a circumferential direction of the sealing window gasket.

In a preferred technical solution of the above spraying system, the spraying system further includes a pressure equalizer having a water inlet and a plurality of water outlets, the water inlet of the pressure equalizer communicates with the water outlet of the circulating pump, and each of the water outlets of the pressure equalizer communicates with one of the water spraying pipes respectively.

In a preferred technical solution of the above spraying system, the spraying system further includes a water outlet pipe, both ends of which communicate with the water outlet of the circulating pump and the water inlet of the pressure equalizer respectively.

In addition, the present disclosure also provides a sealing window gasket of a drum washing machine, wherein the sealing window gasket is provided with the water retaining structure described above; and/or the sealing window gasket is provided with the groove described above; and/or the sealing window gasket is provided with the water spraying pipes described above.

In addition, the present disclosure also provides a drum washing machine, which includes the spraying system described in any one of the above preferred technical solutions of the spraying system.

It can be understood by those skilled in the art that, in the preferred technical solution of the present disclosure, by disposing a plurality of water spraying pipes on the sealing window gasket and providing a water retaining structure on the sealing window gasket, the water retaining structure can scatter the washing water sprayed from each of the water spraying pipes and reflect the washing water into the inner cylinder. Therefore, the spraying system/drum washing machine of the present disclosure can spray the washing water onto the clothes in the inner cylinder while also simplifying the structure of the spraying device.

As compared with the drum washing machine disclosed in the patent publication No. CN204982446U, when the water spraying pipes and/or the water retaining structure are damaged in the drum washing machine of the present disclosure, it is only required to detach, repair and replace the sealing window gasket without detaching the outer cylinder, so that the detachment, maintenance and installation of the spraying device of the drum washing machine is facilitated.

In a feasible embodiment of the present disclosure, grooves are provided on the sealing window gasket, and a plurality of water spraying pipes are disposed in the grooves at equal intervals in the circumferential direction of the sealing window gasket. The water retaining structure is a water retaining ring integrally formed on the sealing window gasket.

BRIEF DESCRIPTION OF THE DRAWINGS

Preferred embodiments of the present disclosure will be described below with reference to the accompanying drawings, in which.

DETAILED DESCRIPTION

Figure 1:
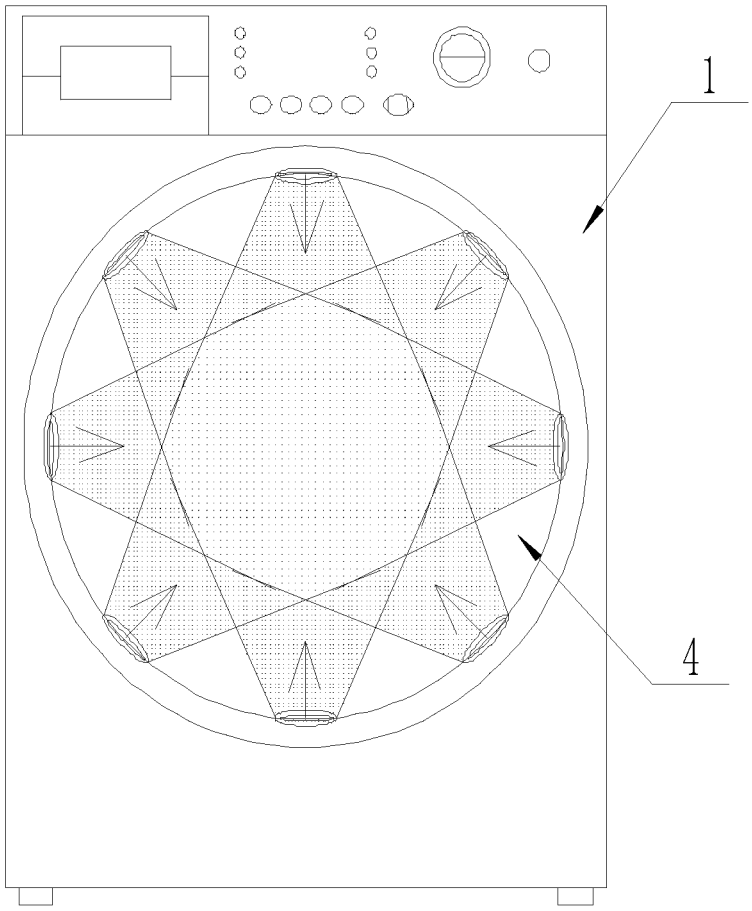
FIG. 1 is a front view of a drum washing machine of the present disclosure.

It should be understood by those skilled in the art that the embodiments in this section are only used to explain the technical principles of the present disclosure, and are not intended to limit the scope of protection of the present disclosure. For example, although the present disclosure is described using a nozzle having a flat structure, the nozzle of the present disclosure may also be a nozzle of any other structure. Those skilled in the art can make an adjustment to the present disclosure as needed to adapt to specific applications, and the adjusted technical solutions will still fall within the scope of protection of the present disclosure.

It should also be noted that in the description of the present disclosure, unless otherwise clearly specified and defined, terms "install", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be an internal communication between two elements. For those skilled in the art, the specific meaning of the above terms in the present disclosure can be understood according to specific situations.

As shown in FIGS. 1 to 4, the drum washing machine of the present disclosure mainly includes a box 1, an outer cylinder 2, an inner cylinder 3, a door 4, a sealing window gasket 5, a drain pump 6 and a drain pipe 7. The outer cylinder 2 is fixedly disposed in the box 1, the inner cylinder 3 is rotatably disposed in the outer cylinder 2, and the sealing window gasket 5 is disposed between the box 1 and the outer cylinder 2. The drain pump 6 and the drain pipe 7 are both disposed in the box 1. A water inlet of the drain pump 6 opens to an inner bottom of the outer cylinder 2, a water outlet of the drain pump 6 is connected to one end of the drain pipe 7, and the other end of the drain pipe 7 opens to the outside. The drain pump 6 can drain washing water in the outer cylinder 2 through the drain pipe 7.

In addition, it can be understood by those skilled in the art that when each part of the drain pipe 7 is lower than an inner bottom end of the outer cylinder 2, those skilled in the art may also omit the drain pump 6 as needed, and replace the drain pump 6 with a cut-off valve. When the drum washing machine needs to drain water, the cut-off valve is opened, so that the washing water in the outer cylinder 2 is automatically discharged from the drain pipe 7 under the action of its own gravity.

Figure 2:
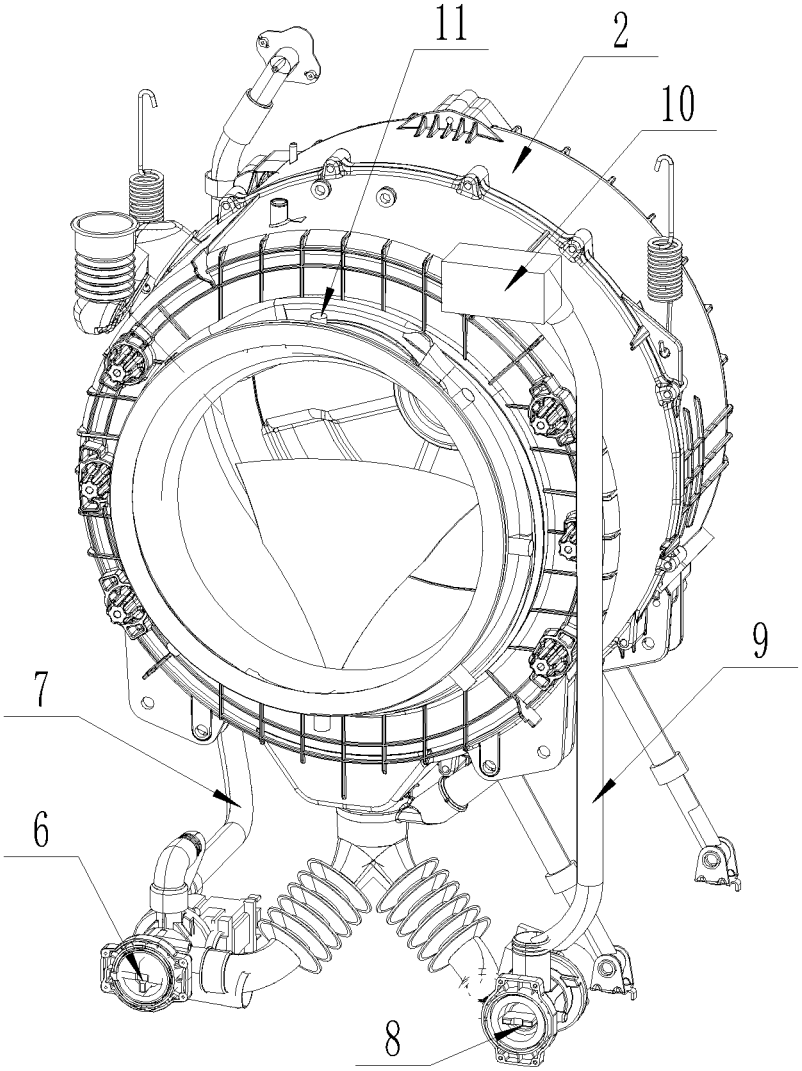
FIG. 2 is a schematic view of an internal structure of the drum washing machine of the present disclosure.

With continued reference to FIGS. 1 and 2, a front end of the box 1 is provided with a box opening (not marked), a front end of the outer cylinder 2 (the right side of the outer cylinder 2 in FIG. 4) is provided with an outer cylinder opening (not marked), and a front end of the inner cylinder 3 (the right side of the inner cylinder 3 in FIG. 4) is provided with an inner cylinder opening (not marked). One end of the sealing window gasket 5 is sealedly connected with an edge of the box opening, and the other end of the sealing window gasket 5 is sealedly connected with an edge of the outer cylinder opening. The door 4 is pivotally disposed on the box 1, and when the door 4 is closed, the box opening can be closed to prevent the washing water in the outer cylinder 2 from overflowing from the box opening.

With continued reference to FIGS. 1 to 4, the drum washing machine of the present disclosure also includes a spraying system, which mainly includes a circulating pump 8, a water outlet pipe 9, a pressure equalizer 10, and a plurality of water spraying pipes 11. The circulating pump 8 is preferably disposed in the box 1 and fixedly connected to the box 1. Alternatively, those skilled in the art may also arrange the circulating pump 8 to be fixedly connected with the outer cylinder 1 as needed. A water inlet of the circulating pump 8 opens into an interior of the outer cylinder 2. Preferably, the water inlet of the circulating pump 8 is connected to a bottom end of the outer cylinder 2 through a water inlet pipe (not marked). Alternatively, those skilled in the art may also connect the water inlet pipe to any position of the outer cylinder 2 as needed, provided that the water inlet pipe is ensured to be located below a liquid level in the outer cylinder 2. In addition, those skilled in the art may also omit the provision of the water inlet pipe as needed, so that the water inlet of the circulating pump 8 directly communicates with the outer cylinder 2. A water outlet of the circulating pump 8 communicates with a water inlet of the pressure equalizer 10 through the water outlet pipe 9. Alternatively, those skilled in the art may also omit the water outlet pipe 9 as needed, so that the water outlet of the circulating pump 8 directly communicates with the water inlet of the pressure equalizer 10.

It can be understood by those skilled in the art that the number of water spraying pipes 11 of the present disclosure is not limited to the eight shown in the drawings, but may also be any number such as six, nine, ten, etc.

Figure 3:
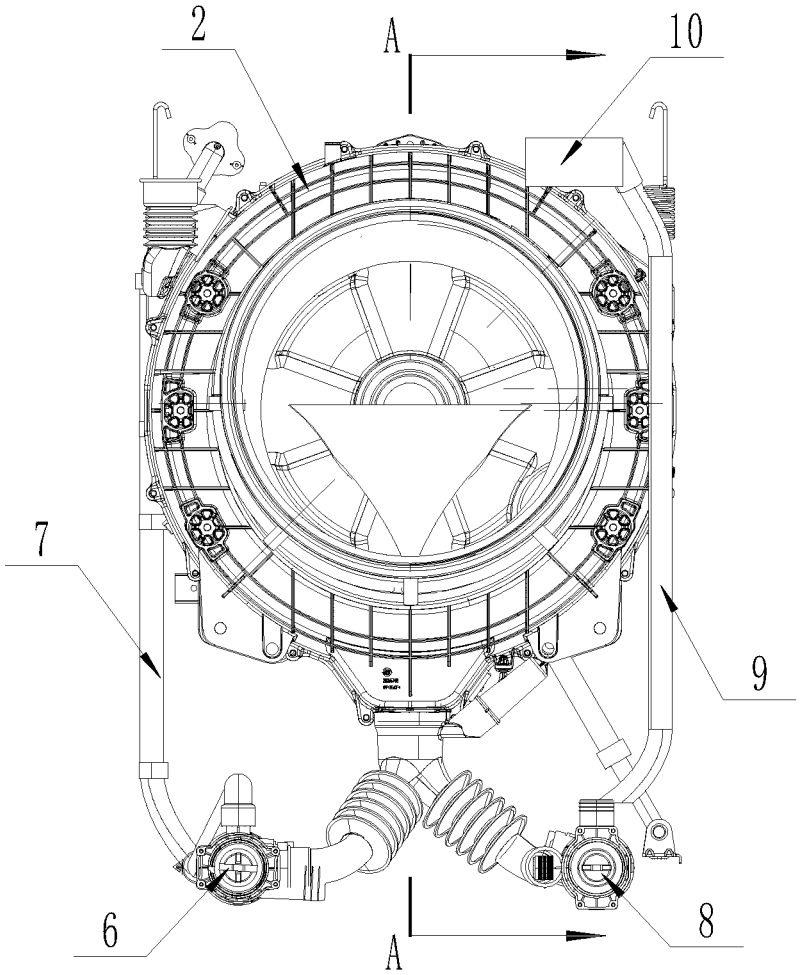
FIG. 3 is a front view of the drum washing machine in FIG. 2.
Figure 4:
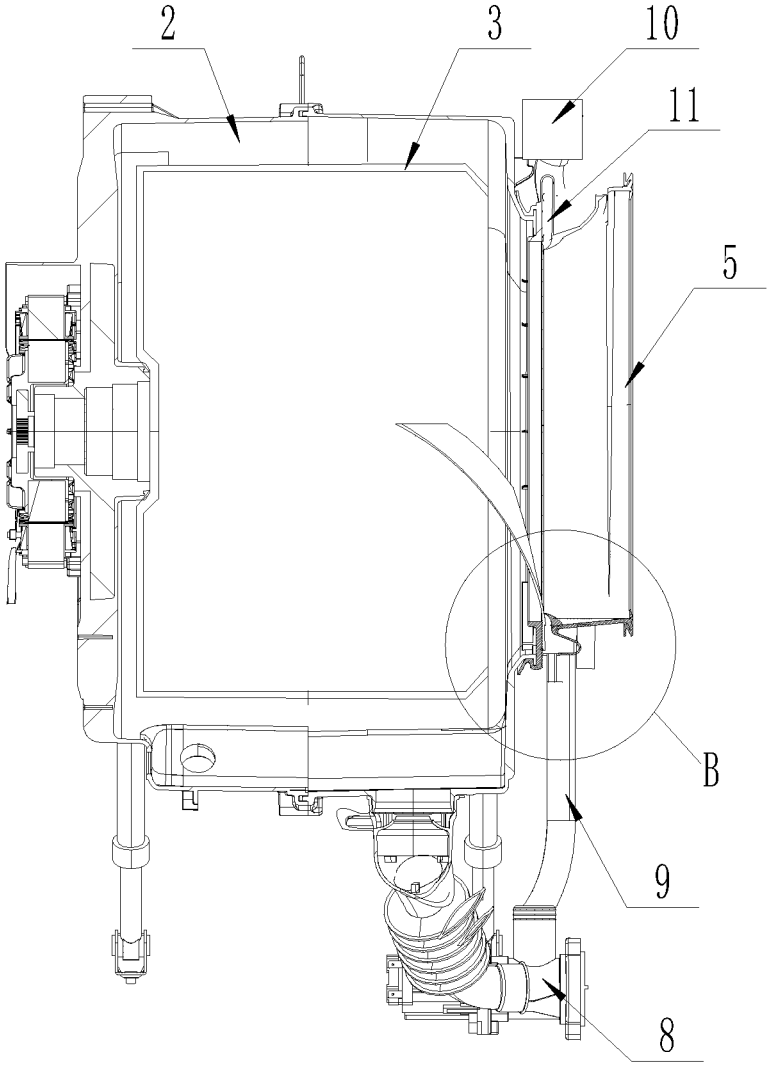
FIG. 4 is a cross-sectional view taken along line A-A in FIG. 3.

As shown in FIGS. 2 to 4, the pressure equalizer 10 is preferably disposed in the box 1 and fixedly connected to the box 1 (for example, to an inner side wall of the box 1). Those skilled in the art may also arrange the pressure equalizer 10 to be fixedly connected to the box 1 in any feasible connection manner as needed. For example, a clamping structure or a fixing structure is provided on the pressure equalizer 10, and the pressure equalizer 10 is fixed to the box 1 by means of the clamping structure or the fixing structure. Alternatively, those skilled in the art may also arrange the pressure equalizer 10 to be fixedly connected to the outer cylinder 1 as needed. The pressure equalizer 10 includes a plurality of water outlets (not shown). Each water outlet of the pressure equalizer 10 is in communication with one water spraying pipe 11. Alternatively, those skilled in the art may, as needed, arrange each water outlet of the pressure equalizer 10 to communicate with one water spraying pipe 11 through another water pipe respectively.

As shown in FIGS. 1 and 2, the plurality of water spraying pipes 11 are disposed at equal intervals on the sealing window gasket 5 in a circumferential direction of the outer cylinder 2. Alternatively, those skilled in the art may also arrange the plurality of water spraying pipes 11 to be disposed at non-equal intervals on the sealing window gasket 5 as needed. All the water spraying pipes 11 pass through the sealing window gasket 5, and are all sealedly connected with the sealing window gasket 5 to prevent the washing water in the outer cylinder 2 from leaking. Alternatively, those skilled in the art may also arrange the water spraying pipes 11 and the sealing window gasket 5 to be integrally formed.

Figure 5:
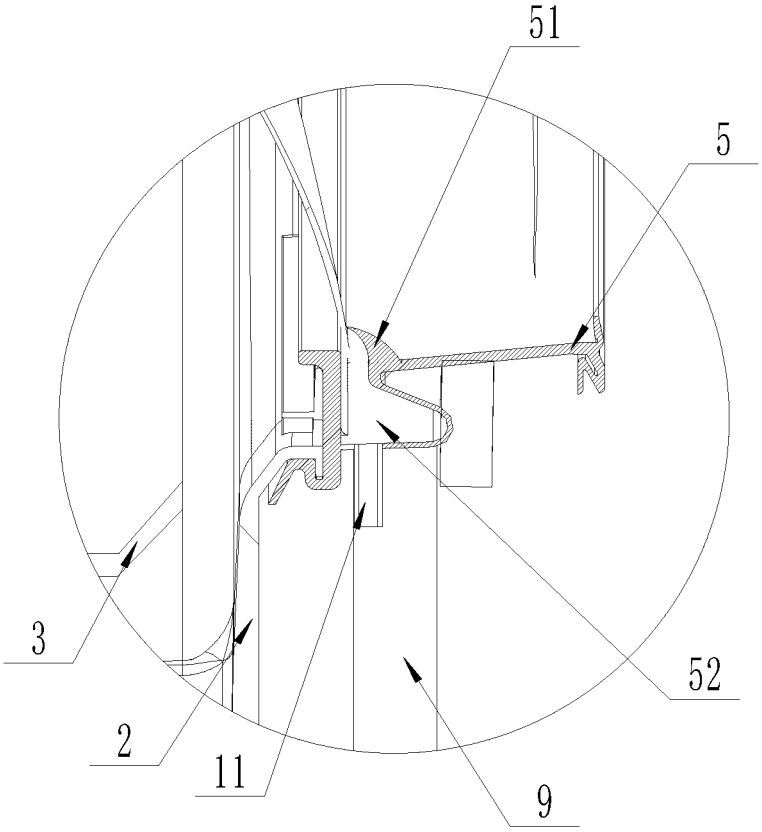
FIG. 5 is an enlarged view of part B in FIG. 4.

As shown in FIGS. 4 and 5, the spraying system of the present disclosure further includes a water retaining structure 51 and a groove 52 that are provided on the sealing window gasket 5. The plurality of water spraying pipes 11 are all disposed in the groove 52, and a water outlet end of each water spraying pipe 11 is located in the groove 52 to prevent clothes from being hooked by the water spraying pipe 11 when the clothes are put into the inner cylinder 3. The water retaining structure 51 is disposed at an edge of the groove 52 and is inclined toward one side of the outer cylinder 2. The water sprayed from the water spraying pipes 11 can be scattered by the water retaining structure 51 and reflected into the inner cylinder 3. It can be understood by those skilled in the art that the groove 52 may also be omitted, provided that the water sprayed from the water spraying pipes 11 can be scattered by the water retaining structure 51 and reflected into the inner cylinder 3. It can also be understood by those skilled in the art that the water retaining structure 51 may be either fixedly connected to the sealing window gasket 5 or integrally formed with the sealing window gasket 5. For example, the water retaining structure 51 and the sealing window gasket 5 may be connected together through a snap-fit connection, or the water retaining structure 51 and the sealing window gasket 5 may be integrally formed by integral injection molding.

In a preferred embodiment of the present disclosure, the water retaining structure 51 is a water retaining ring disposed on an inner side of the sealing window gasket 5. Alternatively, in another embodiment of the present disclosure, those skilled in the art may also configure the water retaining structure 51 as a plurality of water retaining pieces disposed at intervals as needed, and each water retaining piece corresponds to one water spraying pipe 11 respectively.

In a preferred embodiment of the present disclosure, the groove 52 is an annular groove. Alternatively, in another embodiment of the present disclosure, those skilled in the art may also configure the groove 52 as a plurality of grooves disposed at intervals as needed, and each groove corresponds to one water spraying pipe 11 respectively.

When the spraying system of the present disclosure is working, the circulating pump 8 pumps the washing water in the outer cylinder 2 to the pressure equalizer 10, and the pressure equalizer 10 distributes the washing water to the plurality of water spraying pipes 11 at an equal pressure. The plurality of water spraying pipes 11 spray the washing water to the water retaining structure 51, and the water retaining structure 51 scatters and reflects the washing water into the inner cylinder 3 to wash clothes. When the inner cylinder 3 is operating at a high speed, a water flow sprayed from the water spraying pipes 11 can quickly pass through the clothes and enter the outer cylinder 2 under the action of centrifugal force and gravity. It can be understood by those skilled in the art that the purpose of distributing the washing water to the plurality of water spraying pipes 11 at an equal pressure by the pressure equalizer 10 is to realize uniform water pressure and water output amount of each water spraying pipe 11 so that the plurality of water spraying pipes 11 can make the washing water form an annular water curtain and spray it into the inner cylinder 3 evenly. It should be noted that, since the pressure equalizer is a component well known to those skilled in the art, no further description will be given herein.

Although not shown in the drawings, in another feasible embodiment of the present disclosure, those skilled in the art may also omit the pressure equalizer 10 as needed, so that the water outlet of the circulating pump 8 directly communicates with the plurality of water spraying pipes 11 respectively.

It should be noted that the drain pump 6 and/or the circulating pump 8 of the present disclosure may be any feasible pump, e.g., a gear pump, a vane pump, a peristaltic pump, a centrifugal pump, etc.

It can be understood by those skilled in the art that in another feasible embodiment of the present disclosure, the drain pump 6 and the circulating pump 8 may be replaced by one pump. In a first example, the drain pump 6 is omitted, the water outlet of the circulating pump 8 communicates with the water outlet pipe 9 and the drain pipe 7 respectively, the water outlet pipe 9 is configured with a first cut-off valve for selectively opening or closing the water outlet pipe 9, and the drain pipe 7 is configured with a second cut-off valve for selectively opening or closing the drain pipe 7. When the drum washing machine performs a spraying operation, the first cut-off valve is opened and the second cut-off valve is closed; and when the drum washing machine performs a draining operation, the first cut-off valve is closed and the second cut-off valve is opened. As a second example, the drain pump 6 is omitted, and a three-way valve is configured for the water outlet of the circulating pump 8 so that the water outlet of the circulating pump 8 can selectively communicate with the water outlet pipe 9 or the drain pipe 7 through the three-way valve. In addition, those skilled in the art may also, as needed, configure the three-way valve to be able to block the communication between the circulating pump 8 and the water outlet pipe 9 as well as the communication between the circulating pump 8 and the drain pipe 7 at the same time.

In summary, in the spraying system of the present disclosure, while ensuring that the clothes in the inner cylinder 3 are effectively sprayed, both the water spraying pipes 11 and the water retaining structure 51 are disposed on the sealing window gasket 5. Not only the installation structure is convenient, but also the original structure of the outer cylinder 2 is maintained, thereby lowering the production cost of the drum washing machine. When the water spraying pipes 11 and/or the water retaining structure 51 are damaged in the drum washing machine of the present disclosure, it is only required to detach, repair and replace the sealing window gasket 5 without detaching the outer cylinder 2, so that the detachment, maintenance and installation of the spraying device of the drum washing machine is facilitated.

Further, through the pressure equalizer 10 disposed between the circulating pump 8 and the plurality of water spraying pipes 11 in the present disclosure, the washing water pumped by the circulating pump 8 is distributed to each of the water spraying pipes 11 at an equal pressure, so that all the water spraying pipes 11 can form an annular water curtain spraying effect, thereby better spraying the clothes in the inner cylinder 3 and optimizing the washing effect of the washing machine.

In addition, the present disclosure also provides a sealing window gasket of a drum washing machine, and the sealing window gasket has some or all of the technical features of the sealing window gasket 5.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principle of the present disclosure, those skilled in the art can make equivalent changes or replacements to relevant technical features, and the technical solutions after these changes or replacements will fall within the scope of protection of the present disclosure.

What is claimed is:

1. A spraying system of a drum washing machine, the drum washing machine comprising a box, an outer cylinder and an inner cylinder disposed in sequence from outside to inside, and a sealing window gasket being disposed between the box and the outer cylinder;

the spraying system comprising a circulating pump, a water retaining structure and a plurality of water spraying pipes;

a water inlet of the circulating pump opens into the outer cylinder, and a water outlet of the circulating pump communicates with the plurality of water spraying pipes respectively for pumping washing water in the outer cylinder to the plurality of water spraying pipes;

each of the plurality of water spraying pipes is disposed on the sealing window gasket;

the water retaining structure is disposed on an inner side of the sealing window gasket, and the water retaining structure is configured to be able to scatter washing water sprayed from each of the water spraying pipes and reflect the washing water into the inner cylinder, wherein the water retaining structure comprises a water retaining ring fixed to or formed on the sealing window gasket; and wherein the plurality of water spraying pipes are disposed at equal intervals surrounding the circumference of the sealing window gasket.

2. The spraying system of the drum washing machine according to claim 1, wherein the water retaining structure is inclined toward one side of the outer cylinder.

3. The spraying system of the drum washing machine according to claim 1, wherein a groove is provided on the sealing window gasket, and a water outlet end of each of the water spraying pipes is disposed in the groove.

4. The spraying system of the drum washing machine according to claim 3, wherein the groove is a single annular groove; or the groove is provided in plural, and each of the grooves corresponds to one of the water spraying pipes.

5. A drum washing machine, comprising the spraying system according to claim 1.

6. A sealing window gasket of a drum washing machine, wherein the sealing window gasket is provided with a water retaining structure disposed on an inner side of the sealing window gasket and a plurality of water spraying pipes, and the water retaining structure is configured to be able to scatter washing water sprayed from water spraying pipes and reflect the washing water into the inner cylinder; and/or the sealing window gasket is provided with a groove on the sealing window gasket, and a water outlet end of each of the water spraying pipes is disposed in the groove, wherein the water retaining structure comprises a water retaining ring fixed to or formed on the sealing window gasket; and wherein the plurality of water spraying pipes are disposed at equal intervals surrounding the circumference of the sealing window gasket.

* * * * *